United States Patent [19]

Kaeser

[11] 4,368,134

[45] Jan. 11, 1983

[54] METHOD FOR RETARDING GELATION OF BICARBONATE-CARBONATE-ZEOLITE-SILICATE CRUTCHER SLURRIES

[75] Inventor: James A. Kaeser, Somerset, N.J.

[73] Assignee: Colgate Palmolive Company, New York, N.Y.

[21] Appl. No.: 234,564

[22] Filed: Feb. 13, 1981

Related U.S. Application Data

[63] Continuation of Ser. No. 157,568, Jun. 9, 1980, abandoned, which is a continuation-in-part of Ser. No. 128,574, Mar. 10, 1980, Pat. No. 4,294,718.

[51] Int. Cl.[3] ..... C11D 3/04; C11D 3/12; C11D 11/02; C11D 17/06

[52] U.S. Cl. ..... 252/140; 252/174; 252/174.13; 252/174.14; 252/174.19; 252/174.21; 252/174.25; 252/179

[58] Field of Search ..... 252/91, 140, 174, 174.13, 252/174.14, 174.21, 174.25, 179, 174.19, 89.1

[56] References Cited

U.S. PATENT DOCUMENTS

| | | | |
|---|---|---|---|
| 3,594,323 | 7/1971 | Taylor | 252/526 |
| 3,801,511 | 4/1974 | Lemoff | 252/135 |
| 3,869,399 | 3/1975 | Collins | 252/118 |
| 3,886,098 | 5/1975 | Di Salvo | 252/540 |
| 3,893,955 | 7/1975 | Hewitt | 252/551 |
| 3,915,903 | 10/1975 | Wise | 252/552 |
| 4,075,117 | 2/1978 | Morton | 252/135 |
| 4,157,978 | 6/1979 | Llenado | 252/135 |
| 4,180,485 | 12/1979 | Llenado | 252/532 |
| 4,264,464 | 4/1981 | Gangwisch | 252/91 |

FOREIGN PATENT DOCUMENTS

| | | | |
|---|---|---|---|
| 2003913 | 3/1979 | United Kingdom | 252/91 |

*Primary Examiner*—Dennis L. Albrecht

[57] ABSTRACT

Gelation and setting of desirably miscible and pumpable crutcher slurries comprising sodium carbonate, sodium bicarbonate, zeolite and sodium silicate in an aqueous medium are retarded and often prevented by the addition to such medium of a citric material, such as citric acid and/or water soluble citrate, and magnesium sulfate. Alternatively, magnesium citrate may be employed. The addition of the citric material and magnesium sulfate (or magnesium citrate) appreciably lengthens mixing time available before setting of the mix, increasing it over such times for similar crutcher mixes not containing any anti-gelling material, or including citric material as an anti-gelling component but not incorporating magnesium sulfate. The improved workability of the crutcher mix permits the making of higher solids content crutcher slurries, thereby resulting in significant energy savings and improvements in production rates when the crutcher slurries are subsequently spray dried to free flowing inorganic base bead form, from which commercially acceptable detergent compositions may be made, as by post-spraying with a nonionic synthetic organic detergent in liquid state.

21 Claims, No Drawings

METHOD FOR RETARDING GELATION OF BICARBONATE-CARBONATE-ZEOLITE-SILICATE CRUTCHER SLURRIES

This application is a continuation of application Ser. No. 157,568, filed June 9, 1980, now abandoned, which is in turn a continuation-in-part of application Ser. No. 128,574, filed Mar. 10, 1980, now U.S. Pat. No. 4,294,718.

The present invention relates to non-gelling aqueous slurries of inorganic salt mixtures and to methods for their manufacture. More particularly, it relates to the utilization of certain materials which, in combination, develop an exceptionally good and improved anti-gelling action, preventing gelation, excess thickening and setting up of bicarbonate—carbonate—zeolite—silicate slurries, from which particulate heavy duty synthetic organic detergent compositions may be made, as by spray drying such slurries and post-spraying the resulting dried beads with a synthetic nonionic detergent.

Built synthetic organic detergent compositions in free flowing particulate bead form have been well known-heavy duty laundry products for years. Recently, limitations have been placed on the use of polyphosphate builder salts, such as pentasodium tripolyphosphate, due to alleged detrimental ecological effects thereof, and nonionic synthetic organic detergents of improved detergency and other desirable properties have partially replaced the previously dominant anionic detergents in household washing products. Nonionic detergents are often adversely affected by spray drying temperatures and the "pluming" of drying towers in which they are being processed, and the resulting escapes of the nonionic or decomposition products thereof from the towers are environmentally objectionable. Accordingly, some household laundry detergent compositions are now made by spray drying inorganic builder mixtures, devoid of organic detergent, and subsequently spraying onto the surfaces of the resulting dried beads a nonionic detergent in liquid state, so that it is absorbed by the beads. It has been found that base beads which are satisfactorily absorptive of liquid nonionic detergent can be made from mixtures of alkali metal bicarbonate, alkali metal carbonate, zeolite and alkali metal silicate. Such beads apparently owe at least some of their absorbencies to the nature of the bead made, which, in turn, appears to be due to the presence of the zeolite and also, to any partial decomposition of bicarbonate to carbonate which may occur during the spray drying operation. The silicate in such base beads helps make them firmer and more resistant to powdering and crushing, helps prevent corrosion of aluminum parts with which the slurry, beads or "solutions" thereof may come into contact, and contributes detergent building properties to the composition. However, it has been found that aqueous crutcher mixes containing substantial proportions of bicarbonate, carbonate, zeolite and silicate tend to gel or set prematurely, sometimes before they can be thoroughly mixed and pumped out of a crutcher to spray towers, and consequently, extensive experimentation has been undertaken in an effort to find ways to diminish the tendencies of such systems and of similar systems which do not contain zeolite to solidify or gel in the crutcher.

While various ways may be employed to diminish gelation, the most dramatic successes have been found to result from the uses of small quantities of particular additives, which are surprisingly effective in preventing or retarding gelation. Thus, prior to the present invention it had been discovered by a fellow researcher of the present inventor that small quantities of citric acid or water soluble citrate incorporated in the crutcher mix could delay or prevent gelation and setting of bicarbonate—carbonate—silicate mixes and would allow commercial spray drying thereof, following normal procedures for pumping out the crutcher contents to the spray nozzles. However, while such invented process was and is successful, it has been supplanted by one invented by the present inventor, which represents a significant improvement over it because the anti-gelling effect is greater. In that invention, which is the subject of parent application Ser. No. 128,574, a combination of citric material and magnesium sulfate was found to be of greater anti-gelling effect in bicarbonate—carbonate—silicate crutcher mixes than the citric material alone. (The term "citric material" includes citric acid and water soluble derivatives thereof, e.g., water soluble salts). In addition to improving the anti-gelling activity and increasing the length of time in which a crutcher mix would be workable without the need for significantly larger proportions of anti-gelling agent being incorporated, that invention allowed the use of a lesser proportion of organic material, thereby decreasing the likelihood of the spray dried composition deteriorating in the heat of the dryer, and improving the absorbency and flowability of the product. Also, whereas the citric acid component, if used in larger quantity, could interfere with the absorption of liquid nonionic detergent sprayed onto such spray dried base beads, magnesium sulfate appears to be desirably absorbent, thereby helping to make the product free flowing. Such advantages are also now found to be obtainable by utilizing the presently described citric materials and magnesium sulfate to inhibit premature gelation of crutcher mixes containing alkali metal bicarbonate, alkali metal carbonate, alkali metal silicate and water softening (and detergent building) zeolite. Because the presence of the zeolite in these products affects the gelling rate of the slurries and because the proportions of components in the crutcher mixes are significantly different from those in present application Ser. No. 128,574, the present invention is considered to be sufficiently different to warrant this separate application for patent.

In the aqueous crutcher mix the various dissolved anti-gelling compounds can ionize and therefore it may be considered that in the crutcher mix there are present magnesium, citrate and sulfate ions. Accordingly, crutcher mixes having charged thereto mixtures of compounds that result in the desired ionic composition are also useful for retarding and preventing gelations of inorganic crutcher mixes. Thus, magnesium citrate or magnesium acid citrate could be employed, preferably with sodium sulfate, but also without the sulfate being present, because it is considered that the magnesium and citrate ions are the most effective in inhibiting gelation.

In accordance with the present invention, a miscible and pumpable crutcher slurry which does not prematurely gel or set and which is capable of being mixed and pumped for a period of at least an hour after making, comprises from 40 to 70% of solids and 60 to 30% of water, of which solids content, on a 100% solids basis, about 20 to 45% is sodium bicarbonate, about 10 to 30% is sodium carbonate, about 5 to 25% is sodium silicate of $Na_2O:SiO_2$ ratio within the range of 1:1.4 to 1:3, and about 10 to 65% is zeolite, with the ratio of sodium bicarbonate:sodium carbonate being within the range of about 1:1 to 4:1, the ratio of sodium carbonate:-sodium silicate being within the range of about 1:2.5 to 5:1, the ratio of sodium bicarbonate:sodium silicate being within the range of about 1:1 to 8:1, and the ratio of zeolite:silicate being within the range of about 1:2 to 10:1, and which solids content includes, on a slurry basis, a gelation retarding proportion of a combination of 0.1 to 2% of a citric material selected from the group consisting of citric acid, water soluble citrate(s) and mixtures thereof, and from 0.1 to 1.4% of magnesium sulfate, with the total of such citric material and magnesium sulfate being at least 0.4% of the slurry. The invention also relates to a method for retarding or preventing the gelation of a miscible and pumpable crutcher slurry of the general bicarbonate—carbonate—zeolite—silicate type described, by addition thereto of a citric material and magnesium sulfate, in the described small quantities. The invention is also of similar slurries and methods wherein magnesium citrate is present or is utilized as an anti-gelling material.

Without admitting that for the purpose of the Patent Law it is applicable prior art, it is recognized by the present inventor that prior to his inventions the most preferred way of retarding gelation of bicarbonate—carbonate—silicate crutcher mixes in aqueous media was by the addition of small proportions of citric material, as is described in U.S. patent application Ser. No. 81,799, filed Oct. 4, 1979 by Ronald S. Schreiber. Prior to Schreiber's work citric acid had been a known water softening or organic builder constituent of synthetic organic detergent compositions. Also, it had been suggested that magnesium salts might be added to synthetic detergent compositions or to wash waters containing them so as to increase foaming of anionic syndets in such media, and it was known that magnesium salts of some anionic detergents are water soluble. The problem of soluble silicates forming insoluble products in detergent compositions and in wash waters had been recognized and efforts had been made to prevent objectionable deposits of silicates on laundered articles. In some cases particular polyvalent metals had been utilized to "cap" alkali metal silicates to reduce polymerization thereof. Thus, for example, in U.S. Pat. No. 4,157,978 it is taught that a sodium or potassium silicate having an alkali metal oxide:silica ratio greater than 2 may be reacted with a water soluble salt of aluminum, titanium, zinc, zirconium, tin, vanadium, molybdenum, tungsten, selenium or germanium and the capped alkali metal silicate made may then be reacted with a water soluble material that will provide a carboxylate ion in aqueous solution. Among the various compounds of the mentioned metals that were suggested for reaction with the silicate there were included citrates. The mentioned patent does not suggest magnesium citrate nor does it suggest the combination of magnesium sulfate and citric acid or magnesium compound and water soluble citrate, e.g., sodium citrate or other alkali metal citrate. The crutcher mixes that are spray dried according to the teaching of the patent all include significant proportions of synthetic organic detergent; they are not builder salt crutcher mixes intended for later absorption of detergent. Thus, it appears that although the problem of gelling inorganic salt crutcher mixes has been recognized and the use of citric acid to ameliorate this condition was discovered by Schreiber, and although certain polyvalent metal salts were employed to cap silicates intended for use in detergent composition crutcher mixes to be spray dried, the art does not describe nor does it suggest the use of a combination of citric material and magnesium sulfate (or magnesium citrate) in an inorganic salt base bead crutcher mix to prevent or retard gelation thereof. Neither does the art suggest the exceptionally good and unexpectedly beneficial anti-gelling effect of the combination of such materials of this invention, in an inorganic base bead crutcher mix containing zeolite, with the savings obtained in avoiding crutcher freezes and line blockages and in permitting the processing of higher solids content base bead crutcher mixes of such type, with resulting energy savings and production capacity increases.

Although the anti-gelling features of the present invention may also be obtained with other inorganic builder base compositions than those which are primarily of bicarbonate, carbonate, zeolite, silicate and water, such as those not including the zeolite, very significant anti-gelling effects are noted when the zeolite-containing crutcher mixes are treated by the method of this invention, i.e., addition of citric material and magnesium sulfate (or magnesium citrate). It is sufficient that the zeolite, although hydrated, does not tend to dissolve in the crutcher, and consequently, its presence can cause significant thickening of the mix. Also, the finely divided zeolite particles can serve as nuclei for gel formation and for precipitation.

The slurries or crutcher mixes treated in accord with this invention comprise about 40 to about 70% of solids and are about 60 to about 30% of water. The solids content, on a 100% solids basis, is about 20 to about 45% of sodium bicarbonate, about 10 to about 30% of sodium carbonate, about 10 to about 65% of zeolite and about 5 to about 25% of sodium silicate, of $Na_2O:SiO_2$ ratio within the range of 1:1.4 to 1:3. In such compositions the ratio of sodium bicarbonate:sodium carbonate is within the range of about 1 or 1.2:1 to about 4:1, the ratio of sodium carbonate:sodium silicate is within the range of about 1:2.5 to about 5:1, the ratio of sodium bicarbonate:sodium silicate is within the range of about 1:1 to about 8:1 and the ratio of zeolite:silicate is within the range of about 1:2 to about 10:1. The percentage of citric material, which is citric acid, water soluble citrate, a mixture of such citrates or a mixture of citric acid and such citrate(s), will be from about 0.1 to about 2% and the percentage of magnesium sulfate will be from 0.1 to 1.4%, on a slurry basis. The total of citric material and magnesium sulfate will be at least 0.4% and will usually not exceed 2.5 to 3%, with the percentages mentioned being on a total crutcher mix or slurry basis, such slurry including the mentioned salts, water and any adjuvants which may be present. A preferred range of such total is 0.5 to 3%, more preferably 0.6 to 2% and most preferably, usually, 1 to 2%. Although the employment of a combination of citric material, such as citric acid, and magnesium sulfate is preferable, there may be used in substitution for it from 0.3 to 3%, preferably 0.5 to 2%, of magnesium acid citrate ($M_gHC_6H_5O_7.5H_2O$) or equivalent proportion of equivalent magnesium citrate.

Preferably, the crutcher slurry contains from 50 to 65% of solids, with the balance being water, and of the solids content, 25 to 40% is sodium bicarbonate, 13 to 25% is sodium carbonate, 5 to 25% is sodium silicate of $Na_2O:SiO_2$ ratio within the range of 1:1.6 to 1:2.6, and 35 to 65% is hydrated, water softening zeolite, with the ratio of sodium bicarbonate:sodium carbonate being within the range of 1.5:1 to 3:1, the ratio of sodium carbonate:sodium silicate being within the range of 1:2 to 2:1, the ratio of sodium bicarbonate:sodium silicate being within the range of 2:1 to 5:1, and the ratio of hydrated, water softening zeolite:sodium silicate being within the range of 2:1 to 7:1. In such a slurry the percentages of citric material and magnesium sulfate are 0.1 to 0.8 and 0.1 to 1.2, respectively, with a minimum total of 0.4%. More preferably, the crutcher slurry contains from 55 to 65% of solids and 45 to 35% of water, of which solids content 25 to 35% is sodium bicarbonate, 13 to 20% is sodium carbonate, 8 to 15% is sodium silicate of $Na_2O:SiO_2$ ratio in the range of 1:2 to 1:2.4, and 35 to 50% is hydrated, water softening zeolite. In such more preferred compositions the ratio of sodium bicarbonate:sodium carbonate is within the range of 1.5:1 to 2.5:1, the ratio of sodium carbonate:sodium silicate is within the range of 1:1 to 2:1, the ratio of sodium bicarbonate:sodium silicate is within the range of 2:1 to 4:1, and the ratio of hydrated, water softening zeolite:sodium silicate is within the range of 3:1 to 5:1. In such cases the percentages of gelation preventing citric material and magnesium sulfate are in the ranges of 0.2 to 0.6% and 0.4 to 1.1%, respectively. The materials described herein, except for water, are all normally solid and the percentages and ratios are on an anhydrous basis, although the various materials may be added to the crutcher as hydrates, or dissolved or dispersed in water. Normally, however, the sodium bicarbonate is anhydrous and the sodium carbonate is soda ash. Yet, the carbonate hydrate(s), such as the monohydrate, may also be employed. The silicate is usually added to the crutcher slurry as an aqueous solution, normally of 40 to 50% solids content, e.g., 47.5%, and is preferably added near the end of the mixing process and after previous addings and dispersings and dissolvings of the citric material and magnesium sulfate (or magnesium citrate). The silicate employed will usually be of $Na_2O:SiO_2$ ratio within the range of 1:1.6 to 1:2.6, preferably 1:1.6 to 1:2.4 and more preferably 1:2 to 1:2.4.

The zeolites employed include crystalline, amorphous and mixed crystalline-amorphous zeolites of both natural and synthetic origins which are of satisfactorily quick and sufficiently effective activities in counteracting calcium hardness ions in wash waters. Preferably, such materials are capable of reacting sufficiently rapidly with the calcium ions so that, alone or in conjunction with other water softening compounds in the detergent, they soften the wash water before adverse reactions of such ions with other components of the synthetic organic detergent composition occur. The zeolites employed may be characterized as having a high exchange capacity for calcium ion, which is normally from about 200 to 400 or more milligram equivalents of calcium carbonate hardness per gram of the aluminosilicate, preferably 250 to 350 mg. eq./g. Also they preferably have a hardness depletion rate residual hardness of 0.02 to 0.05 mg. $CaCO_3$/liter in one minute, preferably 0.02 to 0.03 mg./l., and less than 0.01 mg./l. in 10 minutes, all on an anhydrous zeolite basis.

Although other ion exchanging zeolites may also be utilized, normally the finely divided synthetic zeolite builder particles employed in the practice of this invention will be of the formula $$(Na_2O)_x.(Al_2O_3)_y.(SiO_2)_z.wH_2O$$

wherein x is 1, y is from 0.8 to 1.2, preferably about 1, z is from 1.5 to 3.5, preferably 2 to 3 or about 2 and w is from 0 to 9, preferably 2.5 to 6.

The zeolite should be a univalent cation-exchanging zeolite, i.e., it should be an aluminosilicate of a univalent cation such as sodium, potassium, lithium (when practicable) or other alkali metal, ammonium or hydrogen (sometimes). Preferably the univalent cation of the zeolite molecular sieve is an alkali metal cation, especially sodium or potassium, and most preferably is sodium.

Crystalline types of zeolites utilizable as good ion exchangers in the invention, at least in part, include zeolites of the following crystal structure groups: A, X, Y, L, mordenite and erionite, of which types A, X and Y are preferred. Mixtures of such molecular sieve zeolites can also be useful, especially when type A zeolite is present. These crystalline types of zeolites are well known in the art and are more particularly described in the text *Zeolite Molecular Sieves* by Donald W. Breck, published in 1974 by John Wiley & Sons. Typical commercially available zeolites of the aforementioned structural types are listed in Table 9.6 at pages 747–749 of the Breck text, which table is incorporated herein by reference. Also, suitable zeolites have been described in many patents in recent years for use as detergent composition builders.

The zeolite used in the invention is usually synthetic and it is often characterized by having a network of substantially uniformly sized pores in the range of about 3 to 10 Angstroms, often being about 4 A (normal), such size being uniquely determined by the unit structure of the zeolite crystal. Preferably it is of type A or similar structure, particularly described at page 133 of the aforementioned text. Good results have been obtained when a Type 4 A molecular sieve zeolite is employed, wherein the univalent cation of the zeolite is sodium and the pore size of the zeolite is about 4 Angstroms. Such zeolite molecular sieves are described in U.S. Pat. No. 2,882,243, which refers to them as Zeolite A.

Molecular sieve zeolites can be prepared in either a dehydrated or calcined form which contains from about 0 or about 1.5% to about 3% of moisture or in a hydrated or water loaded form which contains additional bound water in an amount from about 4% up to about 36% of the zeolite total weight, depending on the type of zeolite used. The watercontaining hydrated form of the molecular sieve zeolite (preferably about 15 to 70% hydrated) is preferred in the practice of this invention when such crystalline product is used. The manufacture of such crystals is well known in the art. For example, in the preparation of Zeolite A, referred to above, the hydrated zeolite crystals that are formed in the crystallization medium (such as a hydrous amorphous sodium aluminosilicate gel) are used without the high temperature dehydration (calcining to 3% or less water content) that is normally practiced in preparing such crystals for use as catalysts, e.g., cracking catalysts. The crystalline zeolite, in either completely hydrated or partially hydrated form, can be recovered by filtering off the crystals from the crystallization medium and drying them in air at ambient temperature so that their water contents are in the range of about 5 to 30% moisture, preferably about 10 to 25%, such as 17 to 22%. However, the moisture content of the molecular sieve zeolite being employed may be much lower, as was previously described, in which case the zeolite will usually be hydrated during crutching and other processing.

Preferably the zeolite should be in a finely divided state with the ultimate particle diameters being up to 20 microns, e.g., 0.005 or 0.01 to 20 microns, preferably being from 0.01 to 15 microns and especially preferably of 0.1 to 8 microns mean particle size, e.g., 3 to 7 or 12 microns, if crystalline, and 0.01 to 0.1 micron, e.g., 0.01 to 0.05 micron, if amorphous. Although the ultimate particle sizes are much lower, usually the zeolite particles will be of sizes within the range of 100 to 400 mesh, preferably 140 to 325 mesh. Zeolites of smaller sizes will often become objectionably dusty and those of larger sizes may not sufficiently and satisfactorily cover the carbonate-bicarbonate base particles.

It is highly preferred to make the crutcher slurry and the base bead product of this invention (from which a heavy duty built nonionic synthetic organic detergent composition can be produced) of essentially inorganic salts, some water soluble and some water insoluble, in such manner that they will be of bead properties that promote absorption through the bead surfaces of nonionic detergent sprayed thereon in liquid form. Therefore, adjuvants, such as perfumes, colorants, enzymes, bleaches and flow promoting agents, are often sprayed onto the beads with the nonionic detergent or are post-added, so that their presence in spray dried beads does not inhibit absorption of the detergent. However, for stable and normally solid adjuvants, mixing in with the inorganic salt slurry in the crutcher can also be feasible. Thus, it is contemplated that from 0 to as much as 20% of the crutcher slurry may be of suitable adjuvants or diluents (diluents include inorganic salts, such as sodium sulfate and sodium chloride). However, if such adjuvants are present, normally the proportion thereof will be from 0.1 to 10% and often their content will be limited to 5%, and sometimes to 1 or 2%. Normally the organic material content of the crutcher slurry will be limited to about 5% maximum, so as to avoid any problems of tackiness of the base beads after spray drying and to avoid any adverse effects on absorption of synthetic nonionic organic detergent by the beads. Because magnesium sulfate is inorganic and appears to be useful in aiding absorption of nonionic by the base beads and because it improves the anti-gelling activity of the citric material it allows the use of less citric material and thereby promotes the production of a more desirable base bead, lower in organic content.

The preferred combination gelation preventing materials employed, which have been found to be startlingly successful in preventing gelation, thickening, setting and freezing up of the crutcher slurry before it can be emptied from the crutcher and spray dried, using normal crutching, pumping and spray drying equipment, are citric material and magnesium sulfate. Because the crutcher slurry, including both dissolved and dispersed inorganic salts, is normally alkaline, usually being of a pH in the range of 9 to 12, preferably 10 to 11, when the citric material employed is citric acid it is considered to be ionized and converted to the corresponding citrate or brought into equilibrium with citrate ions. Thus, other soluble citrates may be employed instead of citric acid, including sodium citrate, potassium citrate and magnesium citrate, although for many applications the acid is considered to be superior. Instead of adding citrate, a mixture of the acid and neutralizing agent, e.g., NaOH, KOH, $Mg(OH)_2$, may be used, and instead of the acid form, a citrate plus an acid can be substituted, if desired (although this latter course of action will rarely be followed). The proportion of citric material, in combination with magnesium sulfate, will normally be only sufficient to accomplish the gelation preventing task in the particular crutcher slurry to be treated. However, for safety's sake an excess, e.g., 5 to 20% more than the sufficient quantities of citric material and magnesium sulfate, may be employed. While it is possible to use as much as 3.4% of the combination of citric material and magnesium sulfate, on a crutcher contents weight basis, to retard or prevent gelation, usually from 0.4 to 2.5% will suffice, preferably from 0.5 to 2%. When employing a citrate, such as an alkali metal citrate, one may wish to increase the percentage of the additive slightly to compensate for the presence of the heavier cation but for simplicity's sake the range of proportions of additives given will apply to both the acid and salt forms. With respect to the magnesium compound, the sulfate is highly preferred but this may be replaced by other sources of magnesium as by the magnesium ion in magnesium citrate, when that compound is used, usually in proportion from 0.3 to 3%, preferably 0.5 to 2%, on a slurry basis.

The order of addition of the various components to the crutcher is not considered to be critical, except that it is highly desirable to add the silicate solution last, and if not last, at least after the addition of the gel preventive combination of materials. Also, minor variations in orders of addition may be made under certain circumstances, as when objectionable foaming accompanies the following of a specific order. However, such problems have not been found to be serious. In some instances it is possible to premix the magnesium sulfate and citric material and to add the mixture thereof to the crutcher. In other cases the citric material is added first, followed by the magnesium sulfate, or vice versa. If desired, one or both of the citric material and magnesium sulfate may be premixed with another material or with other materials. In such instances it will be preferred for the anti-gelling additive components to be mixed in with other crutcher mix materials before addition of the silicate to the crutcher. However, in some instances one can add the anti-gelling materials after addition of the silicate, but preferably very promptly thereafter.

Preferably, for the manufacture of the crutcher mix, water will be added to the crutcher initially, followed by magnesium sulfate, part of the citric material, part of the zeolite, bicarbonate, carbonate, the balance of the citric material, the balance of the zeolite, part of the silicate, and the balance of the silicate. Normally, mixer speed and power will be increased as the materials are added. For example, low speeds may be used until after admixing in of the last of the zeolite, when the speed may be increased to medium, and then to high before addition of the second portion of silicate solution. Dispersion-solutions of the individual components may be made beforehand, if feasible. The water employed may be city water of ordinary hardness. In theory, it is preferable to utilize deionized water or distilled water, if available, because some metallic impurities in the water may have a triggering action on gel formation, but that is not considered to be necessary.

The temperature of the aqueous medium in the crutcher will usually be at about room temperature or elevated, normally in the 20° to 70° C. range and preferably will often be from 25° to 40° C. Heating the crutcher medium may promote solution of the water soluble salts of the mix and thereby increase mix mobility. However, the heating operation can slow production rates and therefore an advantage of the present invention is that lower temperature non-gelling slurries are obtainable. Temperatures higher than 70° C. will usually be avoided because of the possibility of decomposition of one or more crutcher mix components, e.g., sodium bicarbonate. Also, in some cases lower crutcher temperatures increase the upper limits of crutcher solids contents, probably due to insolubilizing normally gelling components.

Crutcher mixing times to obtain good slurries can vary widely, from as little as ten minutes for small crutchers and for slurries of higher moisture contents, to as much as four hours, in some cases. The mixing times needed to bring all of the crutcher mix components together in one medium may be as little as five minutes but in some cases, can take up to an hour, although 30 minutes is a preferable upper limit. Counting any such initial admixing times, normal crutching periods will be from 15 minutes to two hours, e.g., 20 minutes to one hour, but the crutcher mix will be such as to be mobile, not gelled or set, for at least one hour, preferably for two hours, and more preferably for four hours or so after completion of the making of the mix, e.g., 10 to 30 hours (before pump-out to the spray tower).

The crutched slurry, with the various salts and any other components thereof, dissolved or in particulate form, uniformly distributed therein, in part due to the desirable anti-gelling effects of the citric compound and the magnesium sulfate, is transferred in usual manner to a spray drying tower, which is located near the crutcher. The slurry is normally dropped from the bottom of the crutcher to a positive displacement pump, which forces it at high pressure through spray nozzles at the top of a conventional spray tower (countercurrent or concurrent), wherein the droplets of the slurry fall through a hot drying gas, which is usually composed of fuel oil or natural gas combustion products, in which the droplets are dried to desired absorptive bead form. During the drying, part of the bicarbonate may be converted to carbonate, with the release of carbon dioxide, which appears to improve the physical characteristics of the beads made so that they become more absorptive of liquids, such as liquid nonionic detergent, which may be post-sprayed onto them subsequently. However, the zeolite component of the base beads made also favors absorption of liquid so less decomposition of bicarbonate still results in a highly absorptive product.

After drying, the product is screened onto them subsequently. However, the zeolite component of the base beads made also favors absorption of liquid so less decomposition of bicarbonate still results in a highly absorptive product.

After drying, the product is screened to desired size, e.g., 10 to 100 mesh, U.S. Standard Sieve Series, and is ready for application of nonionic detergent spray thereto, with the beads being either in warm or cooled (to room temperature) condition. However, the nonionic detergent will usually be at an elevated temperature to assure that it will be liquid; yet, upon cooling to room temperature, desirably it will be a solid, often resembling a waxy solid. Even if at room temperature the detergent is somewhat tacky this caracteristic does not make the final composition poorly flowing because the detergent penetrates to below the bead surface. The nonionic detergent, applied to the tumbling beads in known manner, as a spray or as droplets, is preferably a condensation product of ethylene oxide and higher fatty alcohol, with the higher fatty alcohol being of 10 to 20 carbon atoms, preferably of 12 to 16 carbon atoms, and more preferably averaging 12 to 13 carbon atoms, and with the nonionic detergent containing from 3 to 20 ethylene oxide groups per mole, preferably from 5 to 12, more preferably 6 to 8. Instead of the ethylene oxide being condensed with higher fatty alcohol the lipophilic portion of the detergent may be aromatic, e.g., nonylphenyl, isoctylphenyl or similar alkylphenyls, obtainable from corresponding phenols. The proportion of nonionic detergent in the final product will usually be from 10 to 25%, such as from 20 to 25%.

Whereas when using citric acid alone as the anti-gelling agent, without the magnesium sulfate and without the zeolite, the liquid absorption rate of the base beads would be good, with some base bead compositions and nonionic detergents it could be difficult to have more than 20% of the nonionic detergent sufficiently quickly and satisfactorily absorbed by the base beads. It has been found that the present anti-gelling treatment, applied to a zeolite containing formula and utilizing a mixture of citric material and magnesium sulfate, e.g., citric acid and magnesium sulfate, and often with less citric acid being used to produce the same workability of the crutcher mix, can result in beads of better absorption properties, in which, for example, as much as 22% or even 25% of nonionic detergent may be absorbed in a reasonable time, with the production of a free flowing product.

A preferred finished formulation made from the presently described base beads contains from 15 to 25%, preferably 20 to 25% of the nonionic detergent, e.g., Neodol 23-6.5, made by Shell Chemical Company, 15 to 25% of sodium bicarbonate, 5 to 15% of sodium carbonate, 25 to 35% of zeolite, 5 to 15% of sodium silicate, e.g., of $Na_2O:SiO_2$ ratio of about 1:2.4, 1 to 3% of fluorescent brightener, 0.5 to 2% of proteolytic enzyme, sufficient bluing to color the product and whiten the wash, as desired, 3 or 5 to 10% of moisture, 0.25 to 1.2% of citric material, preferably sodium citrate and 0.8 to 2% of magnesium sulfate. Instead of the mixture of citric material and magnesium sulfate there may be present from 0.3 to 3% of magnesium citrate, preferably 0.5 to 2%. Optionally, sodium sulfate may be present, as a diluent, but the amounts thereof will normally be restricted to 20%, preferably to 10%, and most preferably to less than 5%, if it is present at all. The base beads made, devoid of nonionic detergent and adjuvants, will preferably comprise from 20 to 35% of sodium bicarbonate, 10 to 20% of sodium carbonate, 30 to 45% of zeolite, 10 to 20% of sodium silicate, 0.3 to 2% of sodium citrate and 1 to 2% of magnesium sulfate (or 0.5 to 4% of magnesium citrate), 0 to 10% of adjuvant(s) and/or diluent(s) and 3 to 10% of moisture. In such products the proportion of sodium bicarbonate in the sprayed beads will normally be within the range of 1.2 to 4 times that of sodium carbonate, e.g., 1.5 to 3 times.

The highly beneficial result of incorporating the mentioned small percentages of citric compound and magnesium sulfate or magnesium citrate in the crutcher slurry in accordance with this invention is two-fold, gelation and setting of the crutcher mix in the vessel before complete discharge thereof is prevented, and additionally, higher solids content crutcher slurries may be made. Thus, down times and cleanouts are eliminated. Although many bicarbonate—carbonate—zeolite—silicate mixtures desirably employed in crutcher mixes for making base beads for built particulate nonionic detergent compositions would normally gel and set up in the crutcher, with the present invention, at little expense and without any detrimental effects on the product, the desired proportions of such builder salts can be employed and variations in such proportions can be made, as desired, without fear of freeze-ups in the crutcher. Tests of the final product show no adverse effects due to the presence of the citric material and magnesium sulfate therein. In fact, some positive results, due to metal ion sequestration and improved absorption of nonionic detergent, can result. The presence of the citric material is thought to promote maintenance of the stability of perfumes and colors present and it may help to prevent development of malodors from deteriorations of other organic additives sometimes present, such as proteolytic enzymes and proteinaceous materials. The presence of the citric materials and the magnesium sulfate in the base beads also has the desirable effect of having the gelation preventing material present in any base beads or detergent beads being reworked, so that such material, if off-specification (as for being undersize or for being tower wall buildup), may be mixed with water and made into a more concentrated rework mix for subsequent blending back with the regular crutcher mix. Such mixing with water is easier than would be the case were the anti-gelling composition not present in the case beads to prevent or retard gelation or excessive thickening.

The following examples illustrate but do not limit the invention. Unless otherwise indicated all temperatures are in °C. and all parts are by weight in the examples and throughout the specification. Also, when weights and proportions of zeolite are given these are intended to be for the normal hydrate being used, because it is considered that the zeolite water of hydration does not leave the zeolite and does not become part of the aqueous solvent medium in the present crutching operations.

EXAMPLE 1

At 10,000 pound (4536 kg.) crutcher mix batch is made by mixing in water at a temperature of about 27° C. (80° F.), with low speed crutcher mixing, and sequentially, 216 parts of Epsom salts, 25 parts of citric acid, 1,264 parts of Linde hydrated zeolite 4 A (20% water of crystallization), 1,634 parts of sodium bicarbonate, 821 parts of soda ash, 25 more parts of citric acid and 1,264 more parts of the mentioned zeolite, after which the mixer speed is increased to medium and 814 parts of a 47.5% aqueous solution of sodium silicate ($Na_2O:SiO_2$ ratio of 1:2.4) are admixed, after which the agitator speed is increased to high, and after another 20 seconds an additional 814 parts of the silicate solution are admixed in. Mixing of the entire batch then continues for at least one hour (and in some cases for as many as four hours), during which time about 500 parts of water are lost. During the mixing time the crutcher slurry is continuously mobile and does not gel or cake.

Starting about five minutes after all the conponents of the crutcher mix are present, the mix is dropped from the crutcher to a pump which pumps it at a pressure of about 300 p.s.i. (about 21 kg/sq. cm.) into the top of a countercurrent spray tower wherein the initial temperature is about 800° F. (430° C.) and the final temperature is about 220° F. (105° C.). The essentially inorganic base beads resulting are of a bulk density of about 0.7 g./ml., an initial adhesion of about 40%, a particle size range substantially between 10 and 100 mesh, U.S. sieve series, and a fines characteristic (through U.S. Sieve No. 50) of about 15%. The moisture content of the product is about 7%. The base beads are found to be free flowing, non-tacky, porous, yet firm on the surfaces thereof, and capable of readily absorbing significant proportions of liquid nonionic detergent without becoming objectionably tacky. Detergent products are made with them by spraying a normally waxy nonionic detergent, either Neodol 23-6.5 or Neodol 45-11, in heated liquid state, onto the tumbling bead surfaces so as to make a product containing 20% or 22% of the nonionic detergent (1 or 2% of proteolytic enzyme, e.g., Maxatase ®, and 0.2 or 0.3% of perfume may also be applied to the tumbling beads). The resulting detergent products are excellent heavy duty laundry detergents, especially useful for washing household laundry in automatic washing machines. In addition to their desirable washing properties they are physically and aesthetically advantageous because they are non-dusting and extremely freely flowing, allowing them to be packaged in narrow necked glass and plastic bottles, and to flow readily from these.

Although normally crutcher mixes will be made quickly and may be emptied from the crutcher equally fast, sometimes being made within a period of as little as five minutes and being pumped out of the crutcher in as little as five or ten minutes, it is important that the present mixes be able to withstand at least an hour in the crutcher without gelling or solidifying because sometimes holdups of such times are encountered in commercial production. The described crutcher mix is found to be capable of being held for as long as four hours and often longer, without gelling or solidifying.

In variations of the present experiment the temperature is elevated to 125° F. (52° C.) and the desired crutcher mix may be made and the base beads may be spray dried therefrom without untoward incident. In other variations of the experiment the proportions of the various components may be varied plus or minus 10%, plus or minus 20% and plus or minus 30%, maintaining them within the ranges previously given, and workable crutcher mixes that do not gel and do not solidify for periods of at least an hour are obtainable. When either the citric acid or magnesium sulfate is omitted from the mix or when such is added after the silicate (usually about five minutes thereafter) objectionable gelation often results. It is also noted that the presence of the zeolite also tends to promote gelation so the use of the combination of magnesium sulfate and citric material is especially important with respect to the described crutcher mix formulas.

Instead of using Epsom salts and citric acid, equivalent compounds that also result in the same type of anti-gelling action may be employed. Thus, magnesium citrate, anhydrous magnesium sulfate, sodium citrate and various combinations thereof may be employed. Similarly, other zeolites, such as zeolites X and Y may be used and the zeolites may be of various degrees of hydration. Other orders of addition of the various components of the crutcher mix may be followed but it will usually be desirable to have at least some of the source of magnesium ion and the source of citric ion present in the aqueous medium as early in the manufacturing process as is feasible.

When the critic material and magnesium salt are added as described above the solids content of the crutcher mix may exceed 55% and often may be 65 or 70% without desired gelation taking place within an hour of the completion of the making of the crutcher mix (and often after four hours or more). However, when either the critic material or the magnesium salt or both are omitted from the mix, premature gelation, thickening and precipitation occur, especially at elevated temperatures within the 20° to 70° C. range and at the higher solids contents. In computing the solids contents the water of hydration in the zeolite is considered as a part of the zeolite solid and not as a part of the water content of the crutcher mix. This is because such water of hydration behaves like a solid and is not released into the aqueous medium, being "insoluble" therein during crutching. For the lower solids content crutcher mixes, those of 50–60%, the citric acid content has been reduced to 0.25% in the first working example given supra, with the magnesium sulfate content remaining at 1%, and the mix resulting is still satisfactorily non-gelling. Still, use of the larger proportion is desirable for higher solids content mixes and as a safety measure.

Other variations in the examples herein described may be made, paralleling those given in my copending application Ser. No. 128,574, previously mentioned, which is incorporated herein by reference.

EXAMPLE 2

In a comparative example the formulation and processing described for the first formula of Example 1 are followed except that the solids content of the crutcher mix, including the water of hydration of the zeolite, is 59.6%, the citric acid content is 0.25% and the proportions of sodium bicarbonate and sodium carbonate are changed. In one such experiment, designated 2A, the sodium bicarbonate content is maintained at 16.3% of the crutcher mix (as is basis) and the sodium carbonate content is 7.6%. In Experiment 2B such proportions are changed to 13.1% and 10.7%, respectively and in Experiment 2C they are further modified to 10.0% and 13.8%, respectively. Thus, the ratios of sodium bicarbonate to sodium carbonate in the crutcher mixes are 2.1, 1.2 and 0.7, respectively, instead of 2.0, as in Example 1. It is noted that the crutcher mix of Experiment 2B has a higher viscosity than that of Experiment 2A, but it is still workable and does not gel over a fourhour holding period. However, the mix of Experiment 2C solidifies during silicate addition, showing the importance of maintaining the proportion of sodium bicarbonate to sodium carbonate in the present compositions within the ranges herein described.

EXAMPLE 3

The following formulas are made according to the general method described in the first working experiment of Example 1, with the batch temperatures being within the range of 43° to 46° C. Numerals given in the chart are parts by weight except for the percentage of solids, which is a weight percentage.

| Component | 3A | 3B | 3C | 3D | 3F | 3G |
|---|---|---|---|---|---|---|
| Tap water | 38.9 | 37.6 | 35.1 | 32.7 | 33.7 | 33.0 |
| Citric Acid | — | 0.25 | 0.25 | 0.25 | 0.25 | — |
| $MgSO_4$, anhydrous | — | 1.0 | 1.0 | 1.0 | — | 1.0 |
| Zeolite 4A (20% hydrated) | 22.9 | 22.9 | 23.8 | 24.8 | 24.8 | 24.8 |
| Sodium bicarbonate | 15.6 | 15.6 | 16.3 | 16.9 | 16.9 | 16.9 |
| Soda Ash | 7.9 | 7.9 | 8.2 | 8.5 | 8.5 | 8.5 |
| Sodium silicate (47.5% solids; $Na_2O:SiO_2$ = 1:2.4) | 14.7 | 14.7 | 15.4 | 15.9 | 15.9 | 15.9 |
| % Solids (including zeolite water of hydration) | 53.4 | 54.7 | 56.8 | 59.0 | 58.0 | 58.7 |

The mix of Experiment 3A solidifies in the crutcher during silicate addition. The mixes of Experiments 3B, 3C and 3D are satisfactory and form no gel during silicate additions. Initial vicosities of such mixes are about the same despite the increase in solids content from 3B to 3D but such viscosities for the mix of Experiment 3D are measurably greater then those for the mixes of Experiment 3B and 3C. With the magnesium sulfate being omitted from the formula, the mix of Experiment 3F solidifies during silicate addition. The Experiment 3G crutcher mix does not solidify during silicate addition but does solidify thirty minutes thereafter. Thus, the products of experiments 3A, 3F and 3G are unsatisfactory.

The invention has been described with respect to various examples and illustrations thereof but is not to be limited to these because it is clear that one of skill in the art, with the present description before him, will be able to utilize substitutes and equivalents without departing from the invention.

What is claimed is:

1. A method of retarding or preventing gelation of a miscible and pumpable crutcher slurry containing from about 40 to 70% of solids and 60 to 30% of water, of which solids content, on a 100% solids basis, about 20 to 45% is sodium bicarbonate, about 10 to 30% is sodium carbonate, about 5 to 25% is sodium silicate of $Na_2O$:-$SiO_2$ ratio within the range of 1:1.4 to 1:3, and about 10 to 65% is zeolite, with the ratio of sodium bicarbonate:-sodium carbonate being within the range of about 1:1 to 4:1, the ratio of sodium carbonate:sodium silicate being within the range of about 1:2.5 to 5:1, the ratio of sodium bicarbonate:sodium silicate being within the range of about 1:1 to 8:1 and the ratio of zeolite:silicate being within the range of about 1:2 to 10:1, which comprises preparing a crutcher slurry of the desired composition containing, on a slurry basis, from 0.1 to 2% of a citric material selected from the group consisting of citric acid, water soluble citrate and mixtures thereof, and from 0.1 to 1.4% of magnesium sulfate, with the total of such citric material and magnesium sulfate, in combination, being gelation retarding and at least 0.4% of the slurry, and mixing such composition in a crutcher during preparation thereof.

2. A method according to claim 1 wherein the crutcher slurry contains from 50 to 65% of solids and 50 to 35% of water, of which solids content 25 to 40% is sodium bicarbonate, 13 to 25% is sodium carbonate, 5 to 25% is sodium silicate of $Na_2O:SiO_2$ ratio within the range of 1:1.6 to 1:2.6 and 35 to 65% is hydrated, water softening zeolite, the ratio of sodium bicarbonate:-sodium carbonate is within the range of 1.5:1 to 3:1, the ratio of sodium carbonate:sodium silicate is within the range of 1:2 to 2:1, the ratio of sodium bicarbonate:-sodium silicate is within the range of 2:1 to 5:1 and the ratio of hydrated, water softening zeolite:sodium silicate is within the range of 2:1 to 7:1, and wherein the percentages of gelation preventing citric material and magnesium sulfate are in the ranges of 0.1 to 0.8 and 0.1 to 1.2, respectively.

3. A method according to claim 2 wherein the crutcher slurry is of a temperature in the range of 20 to 70° C., at atmospheric pressure, and the citric material and magnesium sulfate are incorporated in the slurry before addition thereto of at least some of the sodium silicate.

4. A method according to claim 3 wherein the crutcher slurry contains from 55 to 65% of solids and 45 to 35% of water, of which solids content 25 to 35% is sodium bicarbonate, 13 to 20% is sodium carbonate, 8 to 15% is sodium silicate of $Na_2O:SiO_2$ ratio of 1:2 to 1:2.4, and 35 to 50% is hydrated, water softening zeolite, the ratio of sodium bicarbonate:sodium carbonate is within the range of 1.5:1 to 2.5:1, the ratio of sodium carbonate:sodium silicate is within the range of 1:1 to 2:1, the ratio of sodium bicarbonate:sodium silicate is within the range of 2:1 to 4:1 and the ratio of hydrated, water softening zeolite:sodium silicate is within the range of 3:1 to 5:1, and wherein the percentages of gelation preventing citric material and magnesium sulfate are in the ranges of 0.2 to 0.6 and 0.4 to 1.1, respectively.

5. A method according to claim 1 wherein mixing is at a temperature in the range of 20° to 70° C., the citric material and magnesium sulfate are incorporated in the slurry before the sodium silicate, and mixing is continued for at least one hour after completion of the making of the crutcher slurry.

6. A method according to claim 4 wherein the crutcher slurry temperature is from 25° to 40° C., mixing is effected for at least two hours after completion of the making of the crutcher slurry, and at least a part of the crutcher mix is pumped out of the crutcher to a spray drying tower and is spray dried therein after said mixing.

7. A method according to claim 1 wherein citric acid is the gelation preventing citric material in the crutcher slurry.

8. A method according to claim 1 wherein the magnesium sulfate is added to the slurry as epsom salts.

9. A method according to claim 6 wherein citric acid is the gelation preventing citric material in the crutcher slurry.

10. A method according to claim 6 wherein the magnesium sulfate is added to the slurry as epsom salts.

11. A method according to claim 1 wherein from 0.1 to 10% of the crutcher slurry is of adjuvant(s) and/or diluent(s).

12. A miscible and pumpable crutcher slurry comprising from 40 to 70% of solids and 60 to 30% of water, of which solids content, on a 100% solids basis, about 20 to 45% is sodium bicarbonate, about 10 to 30% is sodium carbonate, about 5 to 25% is sodium silicate of $Na_2O:SiO_2$ ratio within the range of 1:1.4 to 1:3, and about 10 to 65% is zeolite, with the ratio of sodium bicarbonate:sodium carbonate being within the range of about 1:1 to 4:1, the ratio of sodium carbonate:sodium silicate being within the range of about 1:2.5 to 5:1, the ratio of sodium bicarbonate:sodium silicate being within the range of about 1:1 to 8:1 and the ratio of zeolite:silicate being within the range of about 1:2 to 10:1, and which solids content includes, on a slurry basis, a gelation retarding proportion of a combination of 0.1 to 2% of a citric material selected from the group consisting of citric acid, water soluble citrates and mixtures thereof, and from 0.1 to 1.4% of magnesium sulfate, with the total of such citric material and magnesium sulfate being at least 0.4% of the slurry.

13. A crutcher slurry according to claim 12 comprising 50 to 65% of solids and 50 to 35% of water, of which solids content 25 to 40% is sodium bicarbonate, 13 to 25% is sodium carbonate, 5 to 25% is sodium silicate of $Na_2O:SiO_2$ ratio within the range of 1:1.6 to 1:2.6, and 35 to 65% is hydrated, water softening zeolite, the ratio of sodium bicarbonate:sodium carbonate is within the range of 1.5:1 to 3:1, the ratio of carbonate:sodium silicate is within the range of 1:2 to 2:1, the ratio of sodium bicarbonate:sodium silicate is within the range of 2:1 to 5:1 and the ratio of hydrated, water softening zeolite:sodium silicate is within the range of 2:1 to 7:1, and wherein the percentages of gelation preventing citric material and magnesium sulfate are in the ranges of 0.1 to 0.8% and 0.1 to 1.2%, respectively.

14. A crutcher slurry according to claim 13 comprising from 55 to 65% of solids and 45 to 35% of water, of which solids content 25 to 35% is sodium bicarbonate, 13 to 20% is sodium carbonate, 8 to 15% is sodium silicate of $Na_2O:SiO_2$ ratio within the range of 1:2 to 1:2.4, and 35 to 50% is hydrated, water softening zeolite, in which the ratio of sodium bicarbonate:sodium carbonate is within the range of 1.5:1 to 2.5:1, the ratio of sodium carbonate:sodium silicate is within the range of 1:1 to 2:1, the ratio of sodium bicarbonate:sodium silicate is within the range of 2:1 to 4:1 and the ratio of hydrated, water softening zeolite:sodium silicate is within the range of 3:1 to 5:1, and wherein the percentages of gelation preventing citric material and the magnesium sulfate are in the range of 0.2 to 0.6% and 0.4 to 1.1%, respectively.

15. A method of making a particulate base material in bead form, suitable for absorbing nonionic detergent to make a built heavy duty synthetic organic detergent composition, which comprises making a miscible and pumpable slurry in a crutcher by the method of claim 1, pumping the slurry out of the crutcher in ungelled and readily pumpable state and spray drying the slurry to particulate bead form.

16. A product of the process of claim 15.

17. A product according to claim 16 comprising from about 15 to 30% of sodium bicarbonate, 5 to 20% of sodium carbonate, 5 to 15% of sodium silicate, 25 to 45% of zeolite, 3 to 10% of moisture and 0 to 10% of adjuvant(s) and/or diluent(s).

18. A method of retarding or preventing the gelation of a miscible and pumpable crutcher or slurry containing from about 40 to 70% of solids and 60 to 30% of water, of which solids content, on a 100% solids basis, about 20 to 45% is sodium bicarbonate, about 10 to 30% is sodium carbonate, about 5 to 25% is sodium silicate of $Na_2:SiO_2$ ratio within the range of 1:1.4 to 1:3, and about 10 to 65% is zeolite, with the ratio of sodium bicarbonate:sodium carbonate being within the range of about 1:1 to 4:1 the ratio of sodium carbonate:sodium silicate being within the range of about 1:2.5 to 5:1, the ratio of sodium bicarbonate:sodium silicate being within the range of about 1:1 to 8:1 and the ratio of zeolite:silicate being within the range of about 1:2 to 10:1, which comprises preparing a crutcher slurry of the described composition in which there is admixed from 0.3 to 3% of magnesium citrate or magnesium acid citrate, on a slurry basis, and mixing such composition in a crutcher during preparation thereof.

19. A method according to claim 18 wherein the crutcher slurry contains from 50 to 65% of solids and 50 to 35% of water, of which solids content 25 to 40% is sodium bicarbonate, 13 to 25% is sodium carbonate, 5 to 25% is sodium silicate of $Na_2O:SiO_2$ ratio within the range of 1:2 to 1:2.4 and 35 to 65% is hydrated, water softening zeolite, the ratio of sodium bicarbonate:- sodium carbonate is within the range of 1.5:1 to 3:1, the ratio of sodium carbonate:sodium silicate is within the range of 1:2 to 2:1, the ratio of sodium bicarbonate:-sodium silicate is within the range of 2:1 to 5:1 and the ratio of hydrated, water softening zeolite:sodium silicate is within the range of 2:1 to 7:1, and wherein magnesium citrate is admixed and the percentage thereof is in the range of 0.5 to 2%.

20. A miscible and pumpable crutcher slurry comprising from 40 to 70% of solids and 60 to 30% of water, of which solids content, on a 100% solids basis, about 20 to 45% is sodium bicarbonate, about 10 to 30% is sodium carbonate, about 5 to 25% is sodium silicate of $Na_2O$:-$SiO_2$ ratio within the range of 1:1.4 to 1:3, and about 10 to 65% is zeolite, with the ratio of sodium bicarbonate:-sodium carbonate being within the range of about 1:1 to 4:1, the ratio of sodium carbonate:sodium silicate being within the range of about 1:2.5 to 5:1, the ratio of sodium bicarbonate:sodium silicate being within the range of 1:1 to 8:1 and the ratio of zeolite:silicate being within the range of about 1:2 to 10:1, and which solids content includes, on a slurry basis, a gelation retarding proportion of magnesium citrate, from 0.3 to 3% of the slurry.

21. A crutcher slurry according to claim 20 comprising 50 to 60% of solids and 50 to 35% of water, of which solids content 25 to 40% is sodium bicarbonate, 13 to 25% is sodium carbonate, 5 to 25% is sodium silicate of $Na_2O$:$SiO_2$ ratio within the range of 1:2 to 1:2.4 and 35 to 65% is hydrated, water softening zeolite, the ratio of sodium bicarbonate:sodium carbonate is within the range of 1.5:1 to 3:1, the ratio of sodium carbonate:sodium silicate is within the range of 1:2 to 2:1, the ratio of sodium bicarbonate:sodium silicate is within the range of 2:1 to 5:1 and the ratio of hydrated, water softening zeolite:sodium silicate is within the range of 2:1 to 7:1, and wherein the percentage of gelation preventing magnesium citrate is in the range of 0.5 to 2%.

* * * * *